United States Patent [19]

Doyle et al.

[11] 4,334,679

[45] Jun. 15, 1982

[54] HAND-HELD PINBALL GAME

[76] Inventors: Holly T. Doyle; Robert O. Doyle, both of 77 Huron Ave., Cambridge, Mass. 02138; Wendl Thomis, 383 Old Beaver Brook Rd., Acton, Mass. 01718

[21] Appl. No.: 114,882

[22] Filed: Jan. 24, 1980

[51] Int. Cl.[3] ..... A63F 9/00

[52] U.S. Cl. ..... 273/1 E; 273/85 G

[58] Field of Search ..... 273/1 E, 85 G, 237, 273/238

[56] References Cited

U.S. PATENT DOCUMENTS

| | | | |
|---|---|---|---|
| 3,348,844 | 10/1967 | Lemelson | 273/1 E X |
| 4,017,081 | 4/1977 | Windisch | 273/237 X |
| 4,171,135 | 10/1979 | Doyle et al. | 273/237 |
| 4,231,577 | 11/1980 | Thomas et al. | 273/238 |

*Primary Examiner*—William H. Grieb

*Attorney, Agent, or Firm*—Kenway & Jenney

[57] ABSTRACT

In the hand-held pinball game disclosed herein, the movement of the ball is simulated by sequentially energizing light emitting diodes disposed along a multiplicity of predetermined ball paths connecting various features on the playing field. Other light emitting diodes are selectively energized under manual control to simulate flippers which constitute features on the playing field. A digital processor operating under fixed instructions controls the simulated ball movement and implements a timing function during certain segments of the program for determining the time of flipper operation in relation to simulated ball movement. The direction of departure of the simulated ball from the flipper feature is then varied as a function of the time value so determined. The processor also drives a loudspeaker to generate sounds appropriately characterizing the arrival of the simulated ball at various features.

5 Claims, 10 Drawing Figures

```
S11306000240731170 33C470115FC39B75337B3523
S11306107233713 47B337D337F307D387734B42A41
S11306202C411C2B1F2D909F90ABEEB34190A01F2B
S1130630B690AA66E19890A0901EB77629BA46AB08
S1130640CC473F51CA3B3E0094CC6183443D56E1C4
S1130650A9DBA0AFDB9F90ADDBA1B94290A9E19FDC
S1130660B340AEF098A9F0B39EAFEFB862BA94B3BA
S1130670720D8C0C8E629F0C113F1B860C5FF18CEB
S11306807B8E419E3F0D960D180D27ABD29E08D24E
S11306901323656FBE86419A0D1880461FF5401ED0
S11306A0E663E9A1AAE198A9EB4026790F0A003D87
S11306B01092A204E1471F7877060D980D143F0AA3
S11306C00D9B0D14C765E39AB343B36F6FC361B257
S11306D089409EAFFD419AAFDB62C63F0D960D0681
S11306E058F857773710DF627703B0D9B08F043B70C
S11306F0419EAAF6992263D399237A64E51FE73BC6
S1130700100D43B5963B103B0D06103BAB62C199EF
S1130710202 1CD46A11FE696A50C62BF56E062C615
S11307203BA55F1171DA99B3DE61B289401FF0F124
S11307301EF99AAFF7402798ACDEB3409F905AC396
S11307409464E43762BE676F95868CA11FD5A01EA2
S1130750DA1D727194738EA13F1861978967DF4225
S11307609E1EEA40AEE9429CEA9D3F13A6021D6329
S11307706FED219BADFDFC1C02209C1EB3717F1606
S11307803B3F02BA402046239ABA9EB376EEA104B8
S11307904604D513051902983F5C02A01EDF02A18E
S11307A01F0243AFE602AAED730F0A74EF3F0B2852
S11107B07CD3898C461CF802443F8E626FD2C3
S11307C0B346A11F2C02686EC26C6EC561CE61D3A4
S11307D062FD61EF61EE62E3424079757677787A83
S11307E07B7C7E1302727311027F787774737 2704C
S11007F01702037071727374767 87F3B02F8
S1130000676EC1448968F48A69F78B6AF38C6CF46F
S11300108D6EFA1CFCA085F4458BB346733A969614
S1130020 65E185AE8A6CEEB99EA3232FB5E5473F03
S1130030517F3B024586F8B744BBBBB54587E28890
S1130040EF89E38AD68BD2B99D46964022231D249C
S1130050 65E18B2FB5AE89B5418FB7A31CDFA8240A
S1130060B99EAE85AE86EC87B58BB3B7449AAA85A4
S1130070B789B3B57417B5B998B34585F4866CC41C
S1130080 87D588E389F78AFC8B6CCFA185B786AEC8
S1130090 87B58BB1AA85B787B589DCB1457017B32D
S11300A0B999B3838FF12EEC421CB7A84286AA9467
S11300B0B14187E62EAEB586F488ACB385B186CB64
S11300C087B394A885CB86B52EA8B3428AB7B585E5
S11300D0DB87DE89E08AE61CB794B12EB7AE2EB575
S11300E04285AC44BBAC4285ACB387F11DB12EACA8
S11300F0B32EB5AC45856DD586EA876BCE886BD8B3
```

*Fig. 7A*

```
S113010089E68AF78B6AC2A187B58A69D1B186B5B7
S113011087AC89B32E8BA8B185B1866CCB87B38BA2
S1130120E2B5442EBCA8838FF14288B044BBAE0034
S113013000418 6E92EAEB7B99D418E65C367B32EE3
S1130140B3A886D287D589D88ACE1CB72EB142856A
S1130150B3A82FD5AE4399B54285B3AC1DB1B997B9
S1130160B3838FEF2EEB421CB594AE428AB7AA41FB
S113017087E4B04585DC866DD587E18869D489DE5E
S11301808AE18BEBA185AA86CE8AD18BB1B744BC18
S1130190AA449CB186B7886CF189A88AB1AA8383E2
S11301A0B31EA8A31EE7B726B99EB385B589B0B31D
S11301B085A886B38AACB14585B186F08768CF88B7
S11301C0D989E18AE68BECA38C6EC727439CB7855B
S11301D0D787AC89B36BD494B785B787B51DB19471
S11301E0B388B389AEF11EB345BBBBB787F189B3FE
S11301F0B12FAAB74586AA8767C8A185F186B18AB7
S1130200C51CAA94A845BCA87017B32FAAA31DD1D6
S1130210B725B99EB046A51F61FDA21E02A51D66A5
S11302209A46A51CE602448C028DF879170245749F
S11302301702FD83838383024585F38B024279137E
S113024085CD0086CC87CB448CCE72717077760DC9
S1130250467913 7F3BA00D3B67F54489E28AE88B1E
S1130260F002457317026 7FD45761702A11E9A0234
S1130270458567F3771702E6A0994565C2A0753BEB
S113028045BCBC83E1A09B44BCF3A0733B44BBC20C
S1130290A09744BBF3A09A44BCDEA09844BB458518
S11302A0E4646ECE437F3B4786EC3BE1479699E19D
S11302B0A09645BB4785F93BE1448EE1A0EE401F83
S11302C0027129FD1CC91D6FC0461DFA1C0220A520
S11302D027A39B447A3A9B964796467613 3D0DA4F2
S11302E00C17E69746A4BC44A40C17F346A4751750
S11302F0F3402141A39B71606ED42263C8461CC1A4
S1130300C8217717C8616EC3A51F027229EC401C6F
S1130310DE1D0246A51C626EEE21A3763BED461D52
S1130320E6A521A396ED1FE1A51CD6E2257429625A
S1130330CD401C62C31D0246A51D626EF7A3753B2A
S1130340A52002467317C963FDA39646C0A52402DF
S113035000004477 17EB457517EB46A21EDFEBA5AB
S11303601FEB790F0A76606E921980453F5EF65353
S11303700D7D130D1802721761C444761761C0D83D
S113038074786 2F07317CC447817C1D97417F644A3
S11303907617D4DC7717EE7471720DDF780D787AE6
S11303A0433B4579130D3B473F5B02753B02710D9F
S11303B0A50D3B7018028AFB1C787472EFA0990299
S11303C06F6F026FEE7F7E7D7C7B7A7978777673B0
S11303D00B1403E1437370717274767778797D3B03
S11303E0417E7B78777C130266FD65C565CA65D05E
S11303F02F65D566F865DA65F044E37F71163A0235
```

*Fig. 7B*

WINNING

After the last player has played his or her 5th ball, each player's score will be displayed in turn. The player with the highest score is the winner.

SCORING

Once your ball is in play, try to guide it into as many scoring areas as you can. How well you score depends on your skill with the electronic flippers; your ability to follow the ball; and your finesse in hitting targets, bumpers and other scoring spots.

a To light a BUMPER, your ball has to pass through the Roll-Over Lane that's directly above the Bumper. Once you've lit a Bumper, it will stay lit – on *your* turn – until the game ends.

b When you hit a KNOCK-OUT TARGET, its light goes off. Then, when your next turn starts, it will be lit again.

Before your ball can enter the Cave, you must *first* hit the Knock-Out Target directly in front of the Cave.

c Always try to hit the KICKER TARGET. Besides gaining points, you'll also activate the KICKER – which will prevent your ball from entering the Exit Lane.

d Whenever your ball enters the KICK-OUT HOLE, it will be held, then released back into play. The longer your ball is held, the more points you'll score.

Regular points are automatically added to your score during play. BONUS POINTS, on the other hand, are added to your score at the end of your turn. You can score bonus points by hitting the following combinations:

a Try to light all 3 BUMPERS. If you do, you'll receive 15,000 points. Because Bumpers stay lit, you'll also receive 15,000 points on each of your remaining turns.

b Try to hit all 3 KNOCK-OUT TARGETS and the KICKER TARGET. If you hit all 4 on a single turn, you'll receive 20,000 points.

c Try to enter the CAVE after you've lit it. If you do, you'll receive 40,000 points. To light the Cave, you must *first* light all 3 Bumpers and – on one turn – hit all 4 Targets (including the Kicker Target).

*Fig. 8A*

PLAYING

To play, follow these directions *in the proper order:*

1 Press the SHOOTER BUTTON once, and a ball of light will appear in the Firing Chute. The display will show your player number and the number of the ball "in play". Each player receives 5 balls in a game – one ball per turn. *Example:* If you're the second player, playing your fourth ball, the display will show 2-4.

WILDFIRE lets every player change the playing speed during the game. If you wish, you may now select a speed that suits your own skills. Just follow the directions under GETTING READY TO PLAY.

2 Press the Shooter Button again, and the display will show your current score. Then...

Release the Shooter Button, and the ball will travel up through the Firing Chute toward the Roll-Over Lanes. As with a mechanical shooter, you can make the ball travel either "soft" or "hard" through the chute. This feature allows you to aim for a specific Roll-Over Lane. For a "soft" ball, release the Shooter Button *immediately* after pressing it. For a "harder" ball, hold the button down a little longer. For the "hardest" ball, hold the button down until the accompanying "shooter tone" stops playing.

NOTES ON PLAYING

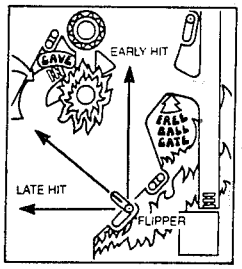

*Whenever you can, use the FLIPPER BUTTONS to guide the ball.*

Direct Contact. By hitting the ball with a flipper, you can control its direction. Hit the ball early and it goes in one direction; hit it late and it goes in another.

Nudge Points. By pressing the closer flipper button when your ball is at one of the six nudge points, you can gain extra ball speed and control. You can, for example, direct your ball to a specific Roll-Over Lane by nudging it back and forth within the Top Arch. Nudging is also useful when you want to maneuver away from the Exit Lane.

Tilt. Like a conventional pinball machine, WILDFIRE will react to overplay. *Use your flippers carefully.* If you press either flipper button more than twice per second, you'll cause a "tilt", and will lose both the ball and all the bonus points you've scored with it.

*Fig. 8B*

HAND-HELD PINBALL GAME

BACKGROUND OF THE INVENTION

The present invention relates to a hand-held pinball simulation game and more particularly to such a game in which the player/machine interaction is vicariously equivalent to that obtained with a conventional, i.e. table mounted, pinball machine.

Conventional table mounted pinball games are intensely physical in the nature of the interaction between the player and the machine. The nature of play is heavily intertwined with the inertial characteristics of the ball itself. Its movements are not precisely controlled by any mechanism and the player can influence the ball both by use of the mechanical flippers that are normally provided and also by nudging the machine, within limits. The player/machine interaction is also significantly augmented by audible cues: not only the bells which are actuated by the machine in response to the movement of the ball but also the thunking sound of the flippers operated by the player and the twanging of the various spring gates through which the ball may pass. Given this highly physical aspect to the interaction between the pinball player and his machine, it can be seen that simulation by a wholly electronic apparatus would not be straightforward or intuitive.

Among the several objects of the present invention may be noted the provision of a hand-held pin ball simulation game in which the player/machine interaction vicariously emulates that enjoyed by the player of a table-mounted pin ball machine, though the simulation is entirely electronic. Other objects include the provision of such a game which incorporates audible cues which aid the player in capturing the spirit characteristic of pin ball aficionados; the provision of such apparatus which is highly reliable and which is of relatively simple and inexpensive construction. Other objects and features will be in part apparent and in part pointed out hereinafter.

SUMMARY OF THE INVENTION

Briefly, in accordance with the present invention, a handheld pin ball simulation game provides a faceplate having indicia corresponding to a pin ball machine, including a plurality of discrete features. Disposed behind the faceplate is an array of discrete light sources disposed along and at intersections of predetermined ball paths connecting the features. At least one of the paths is curved to approximate an arched trajectory. On either side of the faceplate are manually operated control pushbuttons which are associated with light sources corresponding to flippers included within the array. A play initiating pushbutton is also provided, as is a loudspeaker for generating sound cues.

Interconnected with the pushbutton switches, the light sources, and the loudspeaker is an electronic digital circuit including a processor, writable memory, and read-only memory. The read only memory contains data representing the relative locations of the elements of the light source array and an algorithm, started by operation of the play-initiating pushbutton, for simulating ball movement from feature to feature by lighting the sources in sequence and for energizing the speaker to generate sounds appropriately characterizing the arrival of the simulated ball at each feature. The algorithm includes means implementing a timer for determining the time of operation of either of the control push-buttons within certain sequences of the simulated ball and for altering the direction of departure of the simulated ball from the corresponding flipper feature as a function of the time value so determined.

BRIEF DESCRIPTION OF THE DRAWINGS

FIGS. 7A and 7B are a listing designating the fixed data incorporated in the read only memory portion of the microcomputer; and FIGS. 8A and 8B are playing and scoring instructions provided with the commercial embodiment of the invention illustrated herein.

Corresponding reference characters indicate corresponding parts throughout the several views of the drawings.

DESCRIPTION OF THE PREFERRED EMBODIMENT

Figure 1:
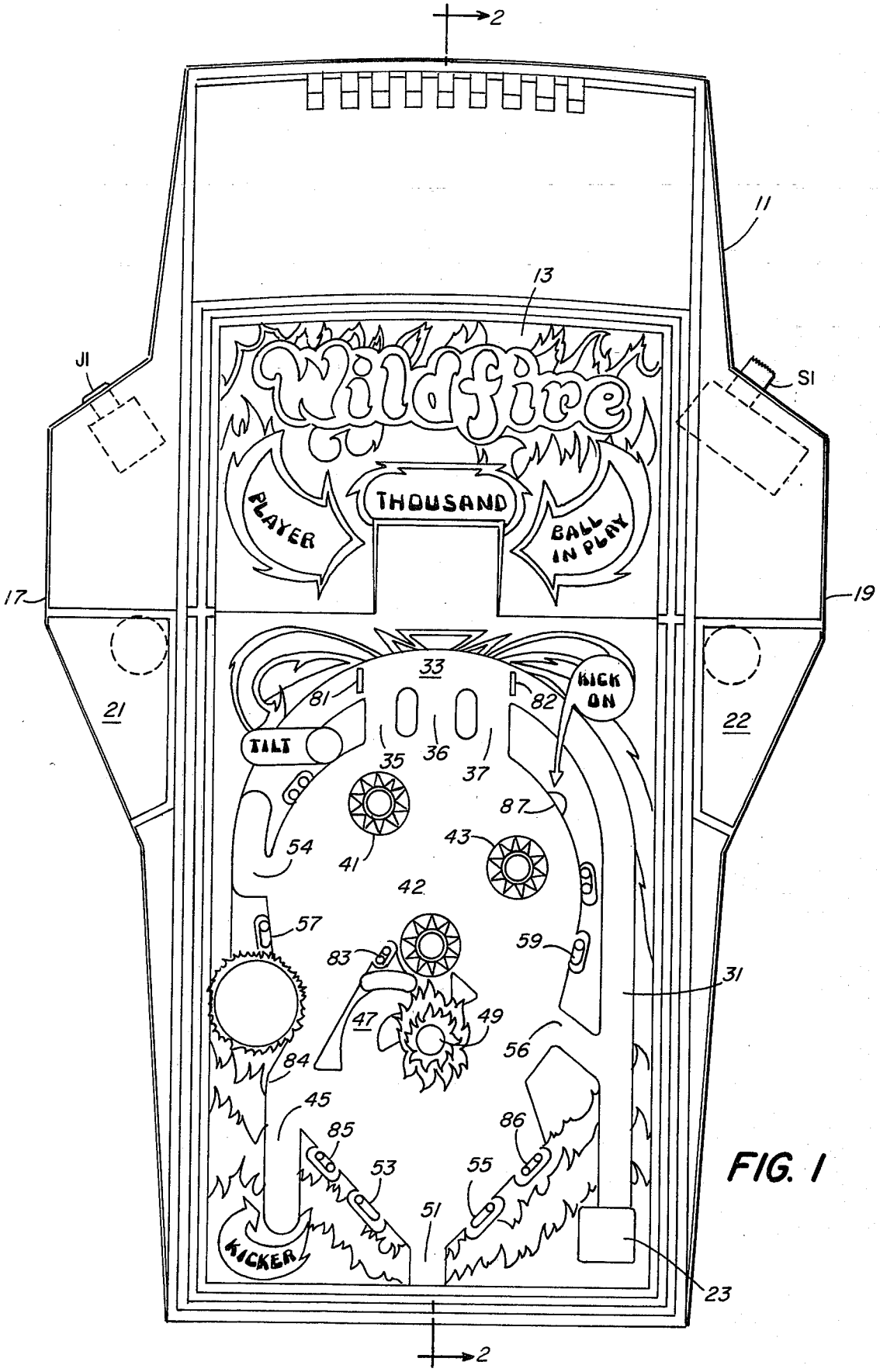
FIG. 1 is a plan view of a hand-held pinball game constructed in accordance with the present invention.
Figure 2:
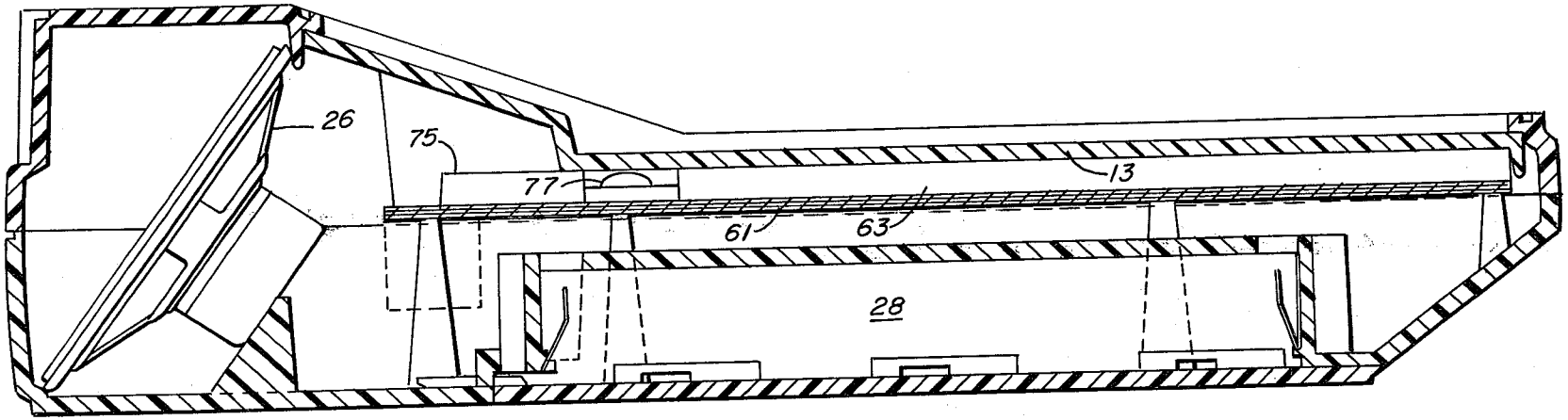
FIG. 2 is a sectional view, substantially along the lines 2—2 in FIG. 1 illustrating the physical and internal arrangement of the game.

Referring now to FIGS. 1 and 2 which illustrate the physical arrangement of the hand-held game, it can be seen that the housing or case 11 supports a faceplate 13 carrying indicia corresponding to a conventional, i.e. table mounted, pinball game. Housing 11 incorporates a pair of wing portions 17 and 19, each of which carries a respective pushbutton 21 and 22, one on either side of the faceplate. The pushbuttons are located so that, when the housing is cradled in a player's hands, the buttons are conveniently located for operation by the player's thumbs. At the lower right hand corner of the faceplate, the housing provides a pushbutton 23 which is employed for play-initiation as described hereinafter.

Indicia on the faceplate 13 defines, as these terms are conventionally used in pinball parlance, a shooting lane 31, an arch 33 and three roll-over lanes 35–37 leading from the arch to the playing field generally. Within the playing field there are three bumpers 41–43, an exit lane 45, a cave 47, and a kick-out hole 49. At the bottom of the playing field is a drain 51, having on either side a representation of a flipper 53 and 55. Flipper-representing indicia are also located as indicated by reference characters 57 and 59, at each side further up on the playing field, i.e. alongside the bumpers. A top-arch gate 54 and a free ball gate 56 are also represented by the indicia. As the term is used herein, each of these items may be considered as a "feature" on the playing field surface.

As indicated previously, movement of the ball is simulated by sequentially energizing individual light sources. Mounted beneath the faceplate in the housing 11, is a circuit board 61 (FIG. 2) which carries an irregular array of light emitting diodes (LEDs) together with various other circuit components described herein. To facilitate a viewing of the light emitting diodes, the faceplate 13 is preferably constructed of a ruby-tinted plastic which appears dark in incident light but is highly transmissive to the red light given off by the LEDs.

Figure 3:
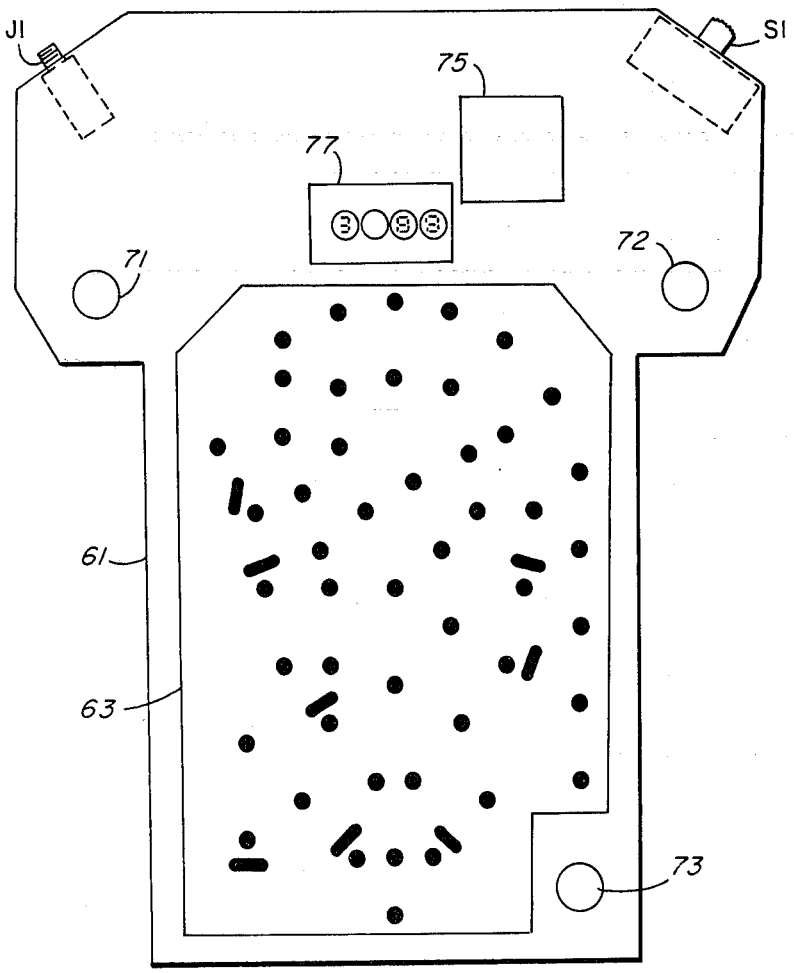
FIG. 3 is a plan view of a circuit board employed in the game, illustrating the pattern of light emitting diodes employed in the apparatus of FIG. 1. The locations of various other components in the circuit board are also indicated.

In a presently preferred commercial embodiment of the invention, the LEDs are applied to the circuit board as individual silicon dice rather than being separately mounted in plastic with leads as separate, discrete components. To efficiently couple the light given off by each LED to the faceplate and to illuminate only a well defined area thereof, a spacer of matrix is interposed between the circuit board and the faceplate, the spacer 63 having a plurality of apertures, one over each LED. Most of the apertures are round, i.e. for representing the ball and the bumpers. However, for certain features, e.g. the flippers and certain gates, the apertures are elongate so as to produce a correspondingly shaped illuminated area on the face plate, e.g. corresponding to the shape of the flippers in the indicia. This is illustrated in FIG. 3 which is a view looking down on the apertured spacer 63. In particular, elongate illuminated gates are provided across the entrances of the top arch 33, the cave 47 and the free ball gate 56. In play, these illuminated features constitute "knock-out" targets which must be hit with the simulated ball, de-energizing the light, before the simulated ball can transverse the entrance to obtain the corresponding scoring increments. A similar illuminated bar is provided at the bottom of the exit lane 45 to represent a selectively energized "kicker" which can expel the simulated ball from the lane, averting its loss.

The circuit board 61 also carries various other electronic components as illustrated in FIG. 3 including a microcomputer 75 and a scoring display 77 of the seven-segment LED type. Snap-acting diaphragm switches 71–73 are located beneath respective ones of the push-buttons 21–23. An on-off and loudness switch S1 and a power jack J1 are also provided. Also carried within the housing 11 are a speaker 26 and a battery holder 28.

Figure 4:
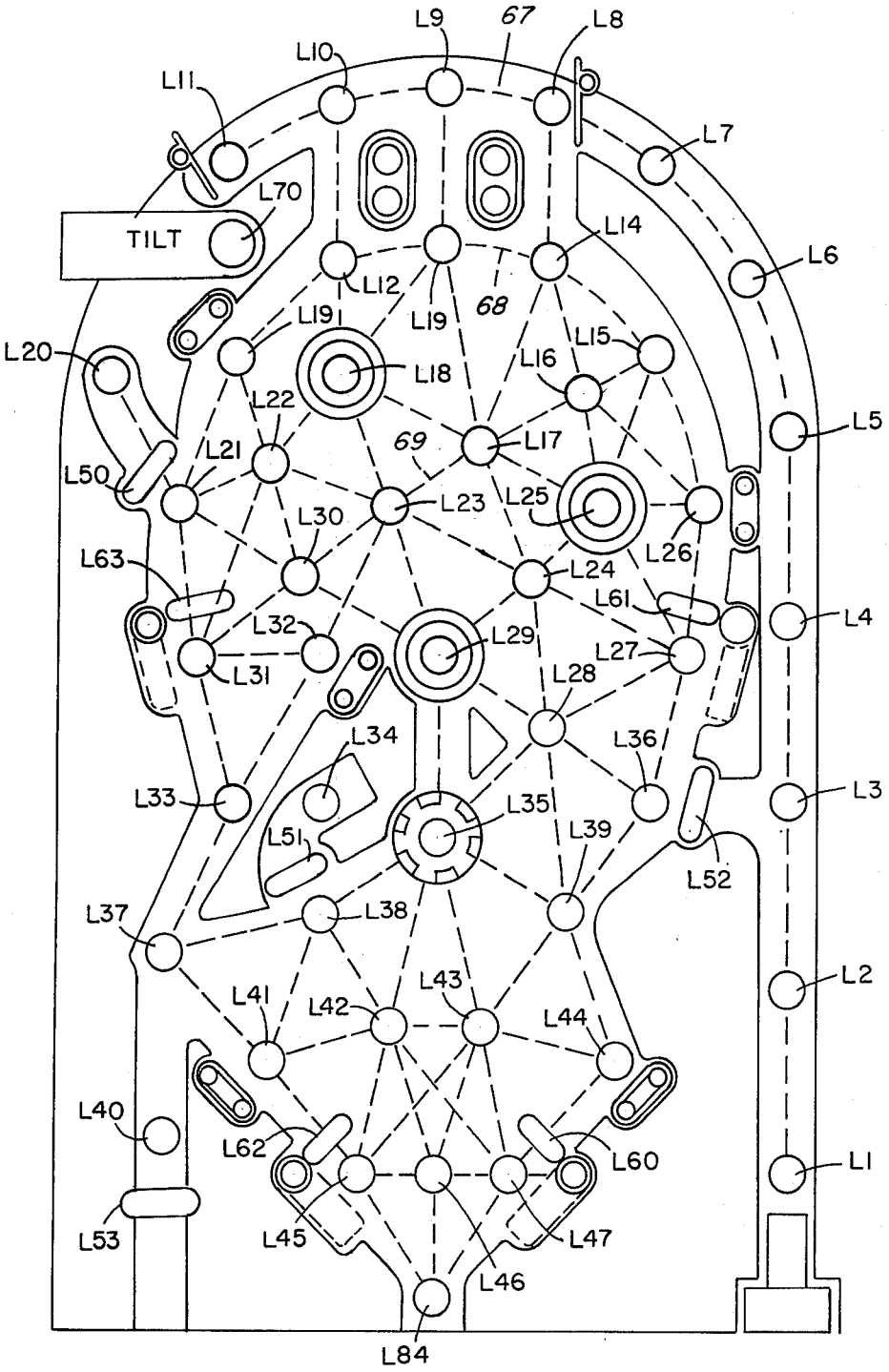
FIG. 4 is a plan view to enlarged scale of a portion of the circuit board corresponding to the playing field illustrating the arrangement of the light-emitting diodes in relation to playing field indicia. Various ball paths are also indicated.

In addition to being located at or adjacent certain of the features defined by the indicia on the faceplate, the LEDs are also distributed in an irregular array so as to be disposed along and at intersections of predetermined ball paths which connect the features. The arrangement of the array of LEDs in relation to possible ball paths and indicia features is illustrated in FIG. 4. In general, the LED positions were selected to fall on the intersection of as many as the defined paths as possible thereby to keep the number of discrete light sources within bounds. The array is necessarily irregular in that certain of the paths, e.g. those designated by the reference characters 67, 68 and 69, are curved. As will be understood, such curved paths are of significant utility in representing true inertial movement of the simulated pin ball in a way which would be less effectively represented with a regular array. Likewise, sufficient paths have been provided so that a variety of paths are available to and from most of the features of the playing field. This is particularly true with respect to the flippers where three to five paths of possible departure direction exit from each flipper.

The availability of a variety of directions of departure from the flippers is particularly significant since, in accordance with one aspect of the present invention, the angle of departure of the simulated pinball from the flipper is varied in accordance with the time of manual actuation of the flipper relative to the timing of the incoming simulated pinball.

Figure 5:
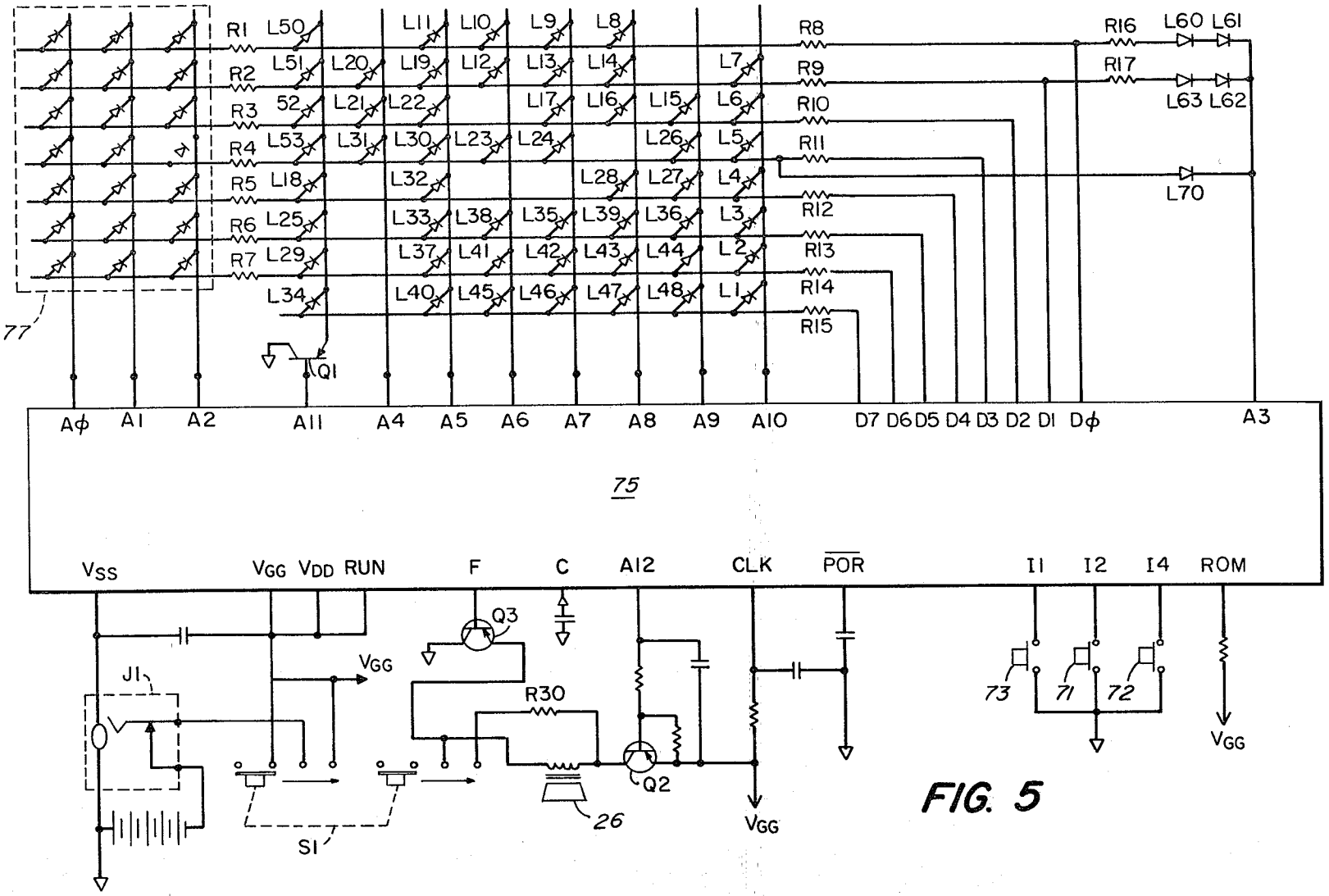
FIG. 5 is a circuit diagram of the electronic system implemented on the circuit board.

FiG. 4 which is, in a sense, an overlay of the playing field indicia with the layout of the LEDs, provides a means for correlating the locations of the LEDs with their arrangement in the circuit diagram of FIG. 5. In general, the position of the simulated ball on the playing field is represented by LEDs L1-L-17, L19–L24, L26–L28, L30, L33, L35–L48, a total of 44 lights, together with other lights located at particular "features". As will be understood by those skilled in the art, the number of light sources to meaningly represent ball movement has been essentially reduced by disposing the lights along, and at the intersections of, realistic ball trajectories including paths which are curved or arched. Reduced in this sense is meant in comparison with a regular array of light sources, i.e. one in which the individual lights are disposed in a grid pattern. The LEDs which simulate the left hand flippers 53 and 57 are L62 and L63 while the corresponding right hand flippers are L60 and L61. The "tilt " indication is provided by LED L70.

The bumpers 41–43 of FIG. 1 are illuminated by LEDs L18, L29, and L25, respectively, of FIG. 4. These diodes are energized to provide a relatively low level of illumination when it is merely desired to indicate that the target has been turned on but are illuminated a higher degree of brightness to signify that the simulated pinball is occupying the same position. The kicker at the bottom of the exit lane 45 is represented by LEDs L53. The "knock-down" targets at the entrances of the upper arch 54, the cave 47, and the free ball lane 56 are represented by LEDs L50, L51, and L52, respectively. In that this last group of light-emitting diodes may be energized continuously at different points in the play, the additional current-sinking capability is provided by a transistor Q1 which buffers the output from the microcomputer 75.

The switch S1 provides two "on" positions, the "off"-'position being the left most in FIG. 5. In the middle position, the system is turned on with full volume to the speaker 26. In the right hand position, the speaker is shunted by a resistor R30 to provide reduced volume. The remaining minor components in the circuit are selected in accordance with the recommendations of the maker of the microcomputer 75 to provide proper clock frequency, power-on reset and the like.

At this point, it is useful to describe the mode of play provided by this apparatus. Pressing the play-initiation button 23 a first time illuminates the bottom LED in the shooting lane, indicating a ball ready to play. Pressing the button 23 a second time, puts the simulated ball into play causing it to traverse the shooting lane with a velocity which is a function of the length of time the button is held down. That is, a longer press gives a faster shot, within predefined limits.

As the ball traverses the shooting lane, a suitable shooting sound is generated in the speaker and as the ball leaves the shooting lane, a twanging sound is generated which simulates the spring gates normally present in a conventional, i.e. table-mounted, pinball game. Similar twanging sounds are generated if the ball rebounds across the arch 33. Depending on the simulated velocity of the shot, the simulated ball will fall through one or another of the gates 35–37. Passing through a particular gate will cause the respective bumpers 41–43 to be illuminated, designating an increased scoring value associated with that target. Except when actually struck by the simulated ball, the level of illumination of each of the bumper targets 41–43 is at a significantly lower level than that provided for the ball during its movement. Thus, the targets can be distinguished from the ball.

In accordance with the mode of play provided, the bumper targets 41–43 impart energy or velocity to the simulated ball, propelling it away from the bumper with an appreciably increased velocity. The particular direction at which the simulated ball departs the bumper is an essentially random function, e.g. determined by a random number generation function within the digital processor apparatus described hereinafter. As the simulated ball encounters each bumper target, a characteristic bell sound is generated through the loudspeaker 26 in a manner closely paralleling the operation of a conventional pinball machine.

As the ball ricochets between the bumpers and the bounds of the playing field as represented by the indicia on faceplate 13, it may come within the ambit of flippers 57 or 59 or, later, within the ambit of the flippers 53 and 55. If the player actuates the flipper, i.e. by depressing the appropriate pushbuttons 21 or 22, the flipper is energized and the simulated pin ball can be propelled thereby. Actuation of the flipper is represented by energization of the corresponding LED, the elongate area of illumination being disposed at an angle relative to the printed indicia on the faceplate so that an appearance of movement is somewhat conveyed.

The particular departure path or angle which a simulated pin ball takes from the flipper is determined by the time of operation of the pushbutton which actuates the flipper. The digital processing apparatus implements a timing function, relative to the timing of the incoming simulated ball, to determine at what time the pushbutton is actuated. If the pushbutton is actuated relatively early within the effective range, the ball is directed into a relatively high path. Conversely, a late actuation causes the ball to depart upon a relatively low path relative to the angle of incidence. In this way, the availability of the plurality of paths and the implementation of the timing function allow a very realistic simulation and a high degree of interaction between the human player and the machine. The excitement of this interaction is also cued to the human player further by the generation, through the loudspeaker 26, of sound cues, e.g. a clunking sound which simulates the sound of operation of the flipper in a conventional pin ball machine.

In the lower field of play, i.e. below the cave 47 and adjacent the flippers 53 and 55, this availability of multiple departure directions and the use of the timing function, actually allows the flippers to, in effect, pass the ball from one flipper to the other, as well as to propel it back up field. In this lower portion of the field of play are included the cave 47 and the kickout hole 49. If the simulated ball is driven to the kickout hole 49, it is held there for a period of time, determined by the random number generator so as to be essentially unpredictable, and then expelled toward one or the other of the flippers 53 or 55 so as to test severely the player's reaction time. Each time the ball is driven to the cave, the player's score is incremented by a predetermined value. If, during play in the lower portion of the playing field, the simulated ball is driven through the free ball chute 56, the program allows the player to have an additional ball to enter into play by means of the play initiating button 26.

If the simulated ball approaches the exit lane 45 at certain angles, it will enter and be lost to the player. Except that, if a kicker target 87 has been previously hit during play, a simulated kicker at the bottom of the escape lane will be energized, indicated by an energized LED, and will kick the ball back out of the chute where it can be again put into play by the flippers.

To emulate further the aura of physical excitement which surrounds conventional play, the embodiment illustrated also provides a "nudge" feature which allows the player to impart additional velocity to the simulated pin ball in a manner corresponding to that obtained by a player of a conventional table-mounted game when he bangs the table in synchronism with the arrival of the physical or inertial ball at certain features on the playing field. In this simulated game, additional velocity can be imparted to the simulated ball by operating the flippers as the ball reaches certain points on the playing field. In the embodiment illustrated, these "nudge" points are indicated by reference characters 81–86. To prevent wholly undisciplined operation of the flippers, however, the game also incorporates a "tilt" feature. A counter is implemented in the software of the microprocessor. This counter is incremented each time the flippers are operated and decremented as a function of time. A "tilt" status is initiated if this count reaches a preselected level. Accordingly, undisciplined or rapid and uncontrolled operation of the flippers will cause the counter to be incremented through this threshold and initiate the tile mode of operation. In the tilt mode of operation, the flippers are disabled, no further scoring is developed, and the ball simply falls into the drain. More controlled operation of the flipper for nudging will not, however, produce this result, since sufficient time will pass between flipper operations to allow the counter to be decremented faster than it is incremented so that the preselected threshold is never reached.

Figure 6:
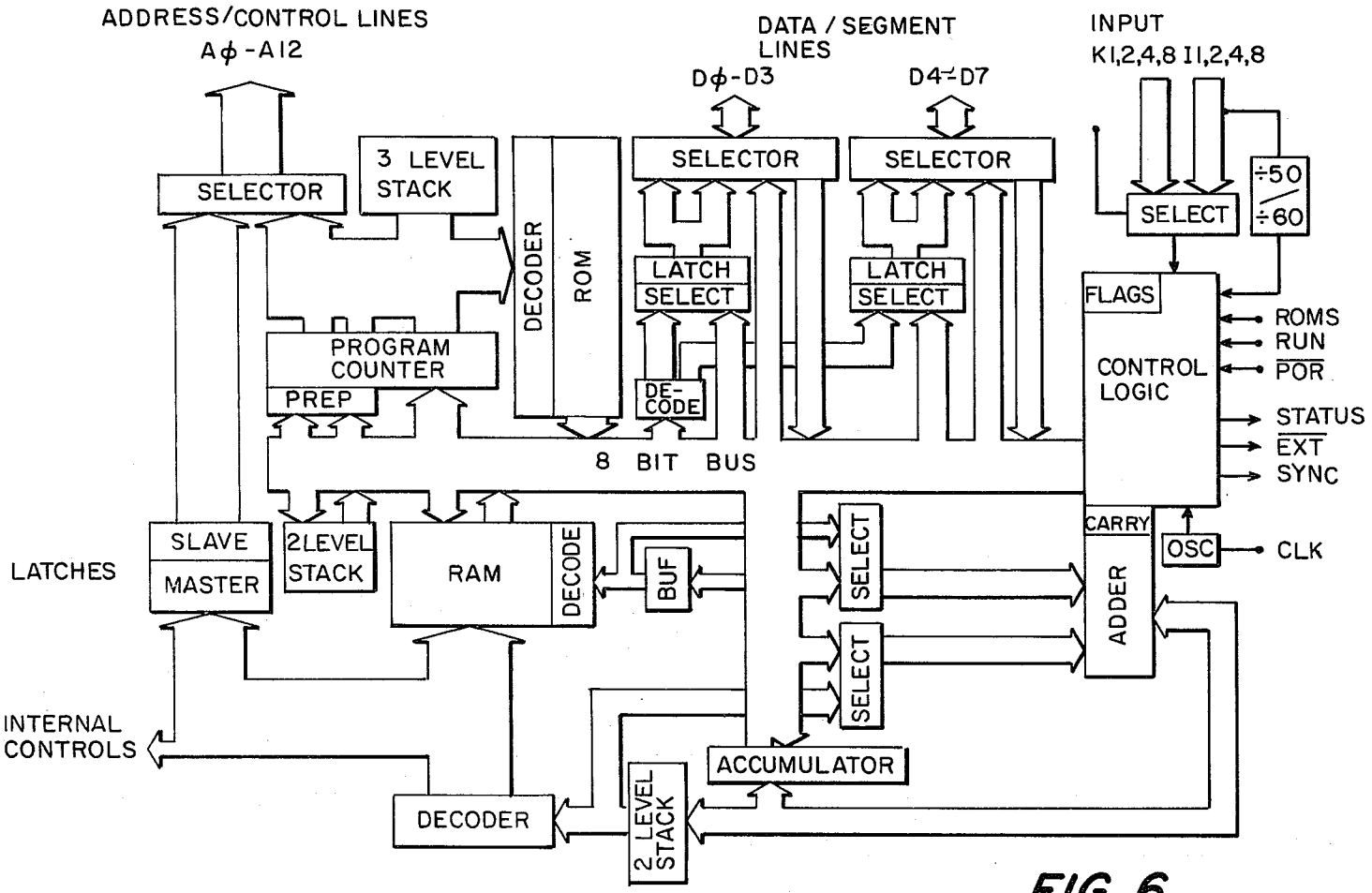
FIG. 6 is a block diagram of microcomputer employed in the circuitry illustrated in FIG. 5.

In the particular embodiment illustrated, the digital processor and the read only memory containing the fixed algorithms determining the ball movement and the predetermined sound cues are all incorporated in a single chip microcomputer. In the version illustrated, the particular microcomputer is the American Micro Systems Inc. model S2150 single chip microcomputer. A block diagram of this particular microcomputer, obtained from the commercial literature of the source company, is shown in FIG. 6. The manner in which this microcomputer is interconnected with the pushbuttons 21, 22, and 23, the loudspeaker 26, the LEDs in the irregular playing field array, and the scoring display 77 is illustrated in the circuit diagram of FIG. 5. The resistors R1 through R17 are current value determining resistors for the various LEDs. The transistor Q3 provides additional current drive capability for the output of the microcomputer which must drive certain of the LEDs which are likely to be continuously energized, e.g. those corresponding to the various target and gate features on the playing field. The transistors Q2 and Q3 provide current for driving the loudspeaker 26.

As indicated previously, the algorithm for simulating ball movement, the algorithms for generating predetermined sound cues, and the algorithm for effecting timing of flipper actuation by the human player in relation to the movement of the simulated ball are contained in the ROM portion of the microcomputer memory, this code being entered into that memory during manufacture of the integrated circuit device by an appropriate masking step during manufacture. As is understood by those skilled in the art, this technique of incorporating customer code in an otherwise standard microcomputer chip is available through a variety of manufacturers at the present time. It should therefore be understood that this game could be implemented with the processors available from other sources and that the particular detailed code would depend upon the instruction set available with the particular microcomputer employed. The actual code employed in a commercial version of this simulated pin ball game using the AMI S2150 microcomputer is given in FIG. 7, the presentation being in hexadecimal form as accepted as standard by the manufacturer.

In addition to the basic pin ball game described above, the particular commercially implemented version illustrated herein provides additional features and embellishments which are not central to the invention described and claimed herein but are incorporated in the disclosure. By utilizing the writable memory store in the microcomputer, the processor can keep track of the scoring of up to four players allowing each of the players to play a ball in turn and restoring the state of the machine as each player's turn comes up. The number of players to be provided for is communicated to the microcomputer by holding down the left flipper button 21 and repeatedly pressing the right flipper button 22 until the desired number of players appears on the scoring display 77.

The device likewise provides for different speeds of play to provide varying degrees of difficulty. The device normally operates in a second or intermediate speed of display, i.e. this is the default value, but a lower or higher speed of a play, Speed 1 or Speed 3, can be obtained by holding down the right flipper button 22 and repeatedly pressing the left flipper button 21 until the number of the desired speed appears on the display 77.

While the present invention was always conceived as a hand-held, wholly electronic device capable of battery powered operation, initial prototypes were constructed using a developmental or prototyping system manufactured by the Intel Corporation of Sunnyvale, CA so that initial programming could be performed using a standard, high level language. This prototyping was done with the understanding that substantial code compaction could then be performed to implement essentially the same system using a single chip microcomputer in which the program code was entered into the read only memory of the microcomputer during manufacture.

We claim:

1. A handheld pinball simulation game comprising:

a faceplate carrying indicia corresponding to a pinball machine and having a plurality of discrete features;

behind said faceplate an array of discrete light sources disposed along and at intersections of predetermined ball paths connecting said features;

on each side of said faceplate, manually operable control pushbuttons, said indicia including at least a pair of flipper features which associate respectively with said pushbuttons, said array including light sources at each of said flipper locations;

a play-initiating pushbutton;

a loudspeaker;

electronic digital circuit means interconnecting said pushbuttons, said light sources and said loudspeaker, said electronic digital circuit means including a processor, writable memory, and read only memory;

wherein said read only memory contains fixed data representing the relative locations of the elements of said array and an algorithm which is started by operation of said play-initiating pushbutton for simulating ball movement from feature to feature by lighting said sources in sequence, the initial velocity of the simulated ball being variable as a function of the length of time said play-initiating pushbutton is operated, said algorithm including also a repertory of said programs for energizing said speaker to generate sounds appropriately characterizing the arrival of the simulated ball at each feature.

2. A handheld pinball simulation game comprising:

a faceplate carrying indicia corresponding to a pinball machine providing a plurality of discrete features;

behind said faceplate, an array of discrete light sources disposed along and at intersections of predetermined ball paths connecting said features, at least one of said paths being curved to approximate an arched trajectory;

on each side of said faceplate, a manually operable control pushbutton, said indicia including at least a pair of flipper features which associate respectively with said pushbuttons, said array including light sources at each of said flipper locations;

a play-initiating pushbutton;

a loudspeaker;

electronic digital circuit means interconnecting said pushbuttons, said light sources and said loudspeaker, said electronic digital circuit means including a processor, writable memory, and read only memory;

wherein said read only memory contains fixed data representing the relative locations of the elements of said array and an algorithm which is started by operation of said play-initiating pushbutton for simulating ball movement from feature to feature by lighting said sources in sequence and for energizing said speaker to generate sounds appropriately characterizing the arrival of the simulated ball at each feature, said algorithm including means implementing a timer for determining the time of operation of either of said play buttons within certain sequences and for altering the direction of departure of the simulated ball from the flipper features as a function of the time value so determined.

3. A game as set forth in claim 2 wherein said game includes means for indicating a "tilt" condition and wherein said processor implements a counter which is incremented by operations of said flipper control pushbuttons and is decremented as a function of time, said "tilt" condition indicating means being energized when said counter reaches a predetermined threshold value.

4. A game as set forth in claim 2 wherein said processor implements a timer which determines how long the play-initiating button is operated and wherein the ball moving algorithm imparts to the simulated ball a velocity which varies as a function of the interval timed.

5. A handheld pinball simulation game comprising:

a hand holdable housing having on top a playing-field faceplate and enclosing a circuit board which underlies said faceplate, said housing enclosing also a battery holder and a loudspeaker, said faceplate carrying indicia corresponding to a pinball machine and having a plurality of discrete features, said circuit board carrying an irregular array of discrete light emitting diodes disposed behind said faceplate and along and at intersections of predetermined ball paths connecting said features, at least one of said paths being curved to approximate an arched trajectory, said housing having a laterally projecting wing portion on either side of said faceplate, each of said wing portions carrying a manually operable control pushbutton, said indicia including at least a pair of flipper features which associate respectively with said pushbuttons, said array including light emitting diodes disposed to illuminate elongate regions adjacent each of said flipper locations;

a play-initiating pushbutton;

a seven segment LED display for presenting scoring for said game, said display being also carried on said circuit board;

electronic digital circuit means interconnecting said pushbuttons, said display, said light emitting diodes and said loudspeaker, said electronic digital circuit means including a processor, writable memory, and read only memory;

wherein said read only memory contains fixed data representing the relative locations of the elements of said array and an algorithm which is started by operation of said play-initiating pushbutton for simulating ball movement from feature to feature by lighting said sources in sequence, for energizing said speaker to generate sounds appropriately characterizing the arrival of the simulated ball at each feature and for correspondingly incrementing a player's score presented on said display, said algorithm including means implementing a timer for determining the time of operation of either of said play buttons within certain sequences and for altering the direction of departure of the simulated ball from the flipper features as a function of the time value so determined.

* * * * *